US010870932B2

(12) United States Patent
Stanhope et al.

(10) Patent No.: US 10,870,932 B2
(45) Date of Patent: Dec. 22, 2020

(54) FLAME RESISTANT FABRICS FOR PROTECTION AGAINST MOLTEN METAL SPLASH

(71) Applicant: Southern Mills, Inc., Union City, GA (US)

(72) Inventors: Michael T. Stanhope, Atlanta, GA (US); Dominique Janay Adams, Fairburn, GA (US); Charles S. Dunn, Griffin, GA (US)

(73) Assignee: Southern Mills, Inc., Union City, GA (US)

( * ) Notice: Subject to any disclaimer, the term of this patent is extended or adjusted under 35 U.S.C. 154(b) by 117 days.

(21) Appl. No.: 16/271,162

(22) Filed: Feb. 8, 2019

(65) Prior Publication Data

US 2019/0242038 A1 Aug. 8, 2019

Related U.S. Application Data

(60) Provisional application No. 62/627,927, filed on Feb. 8, 2018.

(51) Int. Cl.

| | |
|---|---|
| ***D03D 15/12*** | (2006.01) |
| ***D03D 1/00*** | (2006.01) |
| *D03D 15/00* | (2006.01) |

(52) U.S. Cl.

CPC ..... *D03D 15/12* (2013.01); *D03D 1/0035* (2013.01); *D10B 2201/22* (2013.01); *D10B 2321/101* (2013.01); *D10B 2401/04* (2013.01)

(58) Field of Classification Search

CPC ..... D03D 15/12; D03D 1/0035; D10B 2331/021; D10B 2321/101; D10B 2501/04; D10B 2507/00; D10B 2401/04; A41D 31/08; A41D 2400/00; A62B 17/003

See application file for complete search history.

(56) References Cited

U.S. PATENT DOCUMENTS

| | | | | |
|---|---|---|---|---|
| 4,996,099 | A | 2/1991 | Cooke et al. | |
| 5,514,457 | A | 5/1996 | Fels et al. | |
| 7,065,950 | B2 * | 6/2006 | Zhu | D02G 3/047 57/255 |
| 8,133,584 | B2 * | 3/2012 | Zhu | D02G 3/047 428/373 |
| 8,528,120 | B2 | 9/2013 | Underwood et al. | |
| 8,741,789 | B2 | 6/2014 | Li et al. | |
| 8,898,821 | B2 * | 12/2014 | Stanhope | D02G 3/443 2/458 |
| 9,259,599 | B2 * | 2/2016 | Stanhope | D02G 3/443 |
| 9,370,212 | B2 * | 6/2016 | Zhu | A41D 13/02 |
| 9,765,454 | B2 * | 9/2017 | Tutterow | D03D 9/00 |
| 9,938,645 | B2 * | 4/2018 | Stanhope | D03D 1/0035 |
| 10,030,326 | B2 * | 7/2018 | Hines, Jr. | D02G 3/443 |
| 10,316,440 | B2 * | 6/2019 | Stanhope | D02G 3/443 |
| 10,485,281 | B2 * | 11/2019 | Stanhope | B32B 3/266 |
| 10,487,424 | B2 * | 11/2019 | Stanhope | D01F 1/04 |
| 10,704,169 | B2 * | 7/2020 | Habicht | D02G 3/443 |
| 2005/0032449 | A1 | 2/2005 | Lovasic et al. | |
| 2005/0287364 | A1 * | 12/2005 | Zhu | D02G 3/047 428/357 |
| 2007/0123127 | A1 * | 5/2007 | Hirschmann | B32B 5/022 442/136 |
| 2008/0057807 | A1 * | 3/2008 | Tutterow | D03D 15/12 442/1 |
| 2010/0009186 | A1 * | 1/2010 | Zhu | D02G 3/047 428/395 |
| 2010/0112312 | A1 * | 5/2010 | Tutterow | D02G 3/443 428/196 |
| 2010/0297905 | A1 | 11/2010 | Ulrich et al. | |
| 2010/0299816 | A1 * | 12/2010 | Zhu | D02G 3/047 2/458 |
| 2010/0299817 | A1 * | 12/2010 | Zhu | D02G 3/443 2/458 |
| 2011/0010827 | A1 * | 1/2011 | Stanhope | D02G 3/443 2/458 |

(Continued)

FOREIGN PATENT DOCUMENTS

| | | |
|---|---|---|
| WO | 2000000686 A1 | 1/2000 |
| WO | 2004002254 | 1/2004 |

(Continued)

OTHER PUBLICATIONS

Aspland , "Pigments as Colorants: Pigmenting or Pigmentation", Textile Dyeing and Coloration, Chapter 23, 1997, 12 pages.

Drifire , "Introducing Our Lightest Dual Hazard Fabric Ever", Product Line, 2015, 3 pages.

Glenguard™ FR , "Glen Raven Technical Fabrics, LLC", www.glenguard.com, 4 pages.

Mathur et al., "Color and Weave Relationship in Woven Fabrics", Advances in Modern Woven Fabrics Technology, IntechOpen, Jul. 27, 2011, 24 pages.

PCT Patent Application No. PCT/US2019/017254 , International Search Report and Written Opinion, dated Apr. 24, 2019, 12 pages.

Yang et al., "A Durable Flame Retardant for Cellulosic Fabrics", Polymer degradation and stability, vol. 97, Issue 11, Nov. 1, 2012, pp. 2467-2472.

(Continued)

*Primary Examiner* — Robert H Muromoto, Jr.

(74) *Attorney, Agent, or Firm* — Kilpatrick Townsend & Stockton LLP

(57) ABSTRACT

Flame resistant fabrics that provide protection against molten metal splash but that have improved comfort at a lower cost by predominantly locating the protective molten metal shedding fibers on the front face of the fabric. Concentrating the protective fibers predominantly on the front face of the fabric still provides good protection against molten metal adherence and allows for more comfortable and less expensive fibers to be used on the back face of the fabric positioned next to the wearer. In this way, overall protection of the fabric is maintained while improving comfort. Embodiments of such fabrics may also achieve NFPA 70E PPE Category 2 protection, for example ≥8 cal/cm$^2$ arc rating whether ATPV or EBT.

20 Claims, No Drawings

(56) References Cited

U.S. PATENT DOCUMENTS

2011/0159364 A1 6/2011 Nishinaka et al.
2011/0250810 A1* 10/2011 Zhu ..... D02G 3/047 442/199
2011/0281097 A1 11/2011 Li et al.
2012/0090080 A1* 4/2012 Stanhope ..... D03D 1/0035 2/458
2012/0102632 A1* 5/2012 Zhu ..... B32B 5/26 2/455
2012/0122361 A1 5/2012 Hand et al.
2012/0159697 A1* 6/2012 Zhu ..... D02G 3/443 2/455
2012/0286177 A1* 11/2012 Cliver ..... A62B 17/003 250/519.1
2013/0055490 A1* 3/2013 Zhu ..... A41D 1/06 2/458
2013/0055491 A1* 3/2013 Zhu ..... A62B 17/003 2/458
2013/0216810 A1* 8/2013 Hines ..... A41B 1/00 428/219
2014/0026303 A1* 1/2014 Zhu ..... A62B 17/003 2/458
2014/0187113 A1* 7/2014 Hines, Jr. ..... D04H 1/43 442/199
2014/0261852 A1 9/2014 Bonner et al.
2015/0086758 A1* 3/2015 Tutterow ..... D03D 9/00 428/196
2015/0297919 A1* 10/2015 Stanhope ..... A62B 17/003 2/458
2015/0322598 A1* 11/2015 Stanhope ..... D03D 27/08 428/91
2015/0361599 A1 12/2015 Minor
2016/0201236 A1 7/2016 Matsumoto et al.
2016/0362831 A1 12/2016 Minor
2017/0175302 A1* 6/2017 Habicht ..... D03D 1/0035
2017/0203540 A1* 7/2017 Colatruglio ..... B32B 7/09
2017/0295875 A1 10/2017 Ohzeki et al.
2017/0370032 A1* 12/2017 Stanhope ..... D03D 1/0035
2018/0002840 A1* 1/2018 Tutterow ..... D03D 9/00
2018/0030627 A1* 2/2018 Stanhope ..... D03D 15/12
2018/0127899 A1* 5/2018 Tutterow ..... D03D 9/00
2018/0171516 A1* 6/2018 Stanhope ..... D03D 15/12
2018/0313006 A1* 11/2018 Stanhope ..... D03D 15/12
2019/0242038 A1* 8/2019 Stanhope ..... D03D 1/0035

FOREIGN PATENT DOCUMENTS

WO 2012121759 9/2012
WO 2016010659 A1 1/2016
WO 2017070529 4/2017
WO 2017150341 9/2017

OTHER PUBLICATIONS

Extended European Search Report, European Patent Application No. 17816215.2, dated Dec. 17, 2019, 5 pages.

* cited by examiner

FLAME RESISTANT FABRICS FOR PROTECTION AGAINST MOLTEN METAL SPLASH

CROSS-REFERENCE TO RELATED APPLICATIONS

This application claims the benefit of U.S. Provisional Application No. 62/627,927, filed Feb. 8, 2018 and entitled "Fabric for Protection Against Molten Metal Splash," the entirety of which is hereby incorporated by reference.

FIELD

The present invention relates to flame resistant protective fabrics and garments made therefrom that impart improved protection to the wearer.

BACKGROUND

Workers in metal processing plants or foundries are exposed to molten metal. Moreover, many such facilities are electrically-powered, thereby exposing the workers to high voltages, potential electrical arc flash and/or fire/flames. Workers in such environments risk serious burn injury unless they are properly protected. To avoid being injured while working in such conditions, these individuals typically wear protective garments constructed of flame resistant materials designed to protect them from molten metal splash as well as electrical arc flash and/or flames. Optimally, these fabrics are designed to shed molten metal away from the fabric surface, thereby preventing adherence of the molten metal to the fabric and the formation of holes in the fabric caused by molten metal adherence. If molten metal does adhere to the fabric surface, it can cause severe burn injury to the wearer. Such protective clothing can include various garments, for example, coveralls, pants, and shirts. Standards have been promulgated that govern the performance of such garments (or constituent layers or parts of such garments) to ensure that the garments sufficiently protect the wearer in hazardous situations. Fabrics from which such garments are constructed, and consequently the resulting garments as well, are required to pass a variety of safety and/or performance standards.

ASTM F1002 (*Standard Performance Specification for Protective Clothing and Materials for Use by Workers Exposed to Specific Molten Substances and Related Thermal Hazards,* 2015 edition, incorporated herein by reference) "establishes the minimum design and performance requirements for protective clothing and protective clothing materials for both primary and secondary protection from exposure to molten substances and related thermal hazards." The specific molten substances addressed in ASTM F1002 include, for example, iron, steel, and aluminum. ASTM F1002 is directed both to primary protective clothing in which "significant exposure to molten substance splash, radiant heat, and flame is likely to occur" as well as secondary protective clothing in which only "intermittent and incidental exposure to molten substance splash, radiant heat, and flame sources is possible."

Among other things, Table 1 of ASTM F1002 (reproduced below) sets forth the requirements for various tested properties of the woven protective fabrics (both primary and secondary), including, but not limited to, breaking strength (as tested in accordance with D5034*: Test Method for Breaking Strength and Elongation of Textile Fabrics* (*Grab Test*) (2009 edition)), tearing strength (as tested in accordance with ASTM D1424*: Test Method for Tearing Strength of Fabrics by Falling-Pendulum* (*Elmendorf-Type*) *Apparatus* (2009 edition)), vertical flammability (char length and after flame, as tested in accordance with ASTM D6413*: Test Method for Flame Resistance of Textiles* (*Vertical Test*) (2015 edition)), and heat transfer performance/radiant heat resistance (as tested in accordance with ASTM F1939*: Test Method for Radiant Heat Resistance of Flame Resistant Clothing Materials with Continuous Heating* (2015 edition)). All of these testing methodologies are incorporated herein by reference.

TABLE 1

| Specification Requirements, Woven Materials | | | | | |
|---|---|---|---|---|---|
| | Primary | | | | |
| Characteristic | Not Coated, Laminated, or Metalized | Coated, Laminated, or Metalized | Secondary Shirt | Secondary Pants | Section Reference |
| Breaking strength, min, N (lbf) | 223 (50) | 334 (75) | 134 (30) | 223 (50) | 8.1 |
| Tearing strength, N (lbf), min | 22 (5.0) | 45 (10.0) | 11 (2.5) | 22 (5.0) | 8.2 |
| Dimensional change, % | — | — | Report Value | Report Value | 8.3 |
| Durability to Abrasion | — | no aluminum flaking | — | — | 8.4 |
| Adhesion | — | no evidence of separation | — | — | 8.5 |
| Adhesion after wet flexing | — | no delamination or cracking | | — | 8.6 |
| | | Flammability initial | | | |
| Char length, max, mm (in.) | 127 (5.0) | 127 (5.0) | 152 (6.0) | 152 (6.0) | 8.7 |
| After flame, max, s | 2 | 2 | 2 | 2 | 8.7 |
| | After 25 washes/dry cleaning | | | | |
| Char length, max, mm (in.) | 127 (5.0) | 127 (5.0) | 152 (6.0) | 152 (6.0) | 8.7 |
| After flame, max, s | 2 | 2 | 2 | 2 | 8.7 |

TABLE 1-continued

| Specification Requirements, Woven Materials | | | | | |
|---|---|---|---|---|---|
| | Primary | | | | |
| Characteristic | Not Coated, Laminated, or Metalized | Coated, Laminated, or Metalized | Secondary Shirt | Secondary Pants | Section Reference |
| Heat Transfer Performance Radiant Heat Resistance (RHR) min. | 40 | 40 | 7.0 | 7.0 | 8.8.1 & 8.8.3 |
| Molten Substance Splash | See Table 2 | See Table 2 | Report Value | Report Value | 8.8.2 & 8.8.4 |

ASTM F1002 also requires testing of the heat transfer performance of primary and secondary fabrics when exposed to molten metal splash. Primary protective fabrics are tested in accordance with ASTM F955 (*Standard Test Method far Evaluating Heat Transfer through Materials far Protective Clothing Upon Contact with Molten Substances,* 2015 edition, incorporated herein by reference). ASTM F955 involves placing the fabric to be tested over a panel (at a specified angle) containing a calorimeter which measures the heat transfer through the fabric when a specified amount of molten substance is poured at a specific temperature onto the fabric. The test measures the predicted second-degree skin burn injury and provides subjective ratings of the degree of molten substance sticking, material charring, material shrinkage, and material breakopen (formation of a hole in the fabric) when a molten metal is poured onto the fabric being tested (1 being the best rating, 5 being the worst rating).

Testing of the heat transfer performance of secondary protective fabrics includes testing in accordance with ISO 9185 (*Protective Clothing—Assessment of Resistance of Materials to Molten Metal Splash,* 2007 edition, incorporated herein by reference). In general terms, the fabric is tested by positioning an embossed thermoplastic PVC sensor film directly behind and in contact with the fabric. A specified weight of molten substance is poured on the fabric at a specified angle and temperature. If the molten substance does not damage the PVC film underneath the fabric, iterative testing begins increasing the weight of molten substance until either the PVC film is damaged, or the maximum specified weight is reached. The results of ISO 9185 testing are correlated to a rating system (set forth in ISO 11612 described below) whereby the fabric receives a rating of 1-3 (1 being the worst, 3 being the best) dependent on the type of molten metal used in the test and on the amount of the molten substance able to be poured before damaging the film.

ISO 11612 (*Protective Clothing—Clothing to protect against heat and flame—Minimum performance requirements,* 2015 edition, incorporated herein by reference) is an international standard that includes, among other things, performance requirements for fabrics used in protection against molten metal. Sections 7.4 and 7.5 of ISO 11612 contain specific performance requirements for fabrics used in protection against molten aluminum (code letter D) and molten iron (code letter E), respectively. The fabrics are tested in accordance with ISO 9185 (described above), and, based on those results, afforded a performance level rating from D1-D3 (for molten aluminum) and E1-E3 (for molten iron), with a rating of 1 being the worst and a rating of 3 being the best.

ASTM F1506 (*Standard Performance Specification for Flame Resistant and Arc Rated Textile Materials for Wearing Apparel for Use by Electrical Workers Exposed to Momentary Electric Arc and Related Thermal Hazards,* 2018 edition, incorporated herein by reference) governs arc rating testing of protective fabrics. The arc rating value represents a fabric's performance when exposed to an electrical arc discharge. The arc rating is expressed in cal/cm$^2$ (calories per square centimeter) and is derived from the determined value of the arc thermal performance value (ATPV) or Energy Breakopen threshold ($E_{BT}$). ATPV is defined as the arc incident energy on a material that results in a 50% probability that sufficient heat transfer through the specimen is predicted to cause the onset of second-degree burn injury based on the Stoll Curve. $E_{BT}$ is the arc incident energy on a material that results in a 50% probability of breakopen. Breakopen is defined as any open area in the material at least 1.6 cm$^2$ (0.5 in.$^2$). The arc rating of a material is reported as either ATPV or $E_{BT}$, whichever is the lower value. The ATPV and $E_{BT}$ is determined pursuant to the testing methodology set forth in ASTM F1959 (*Standard Test Method for Determining the Arc Rating of Materials for Clothing,* 2014 edition, incorporated herein by reference), where sensors measure thermal energy properties of protective fabric specimens during exposure to a series of electric arcs.

NFPA 70E (*Standard for Electrical Safety in the Workplace,* 2018 edition, incorporated herein by reference) offers a method to match protective clothing to potential exposure levels incorporating Personal Protective Equipment (PPE) Categories. Protective fabrics are tested to determine their arc rating, and the measured arc rating determines the PPE Category for a fabric as follows:

PPE Category and ATPV
PPE Category 1: ATPV/$E_{BT}$: 4 cal/cm$^2$
PPE Category 2: ATPV/$E_{BT}$: 8 cal/cm$^2$
PPE Category 3: ATPV/$E_{BT}$: 25 cal/cm$^2$
PPE Category 4: ATPV/$E_{BT}$: 40 cal/cm$^2$ Thus, NFPA 70E dictates the level of protection a fabric must possess to be worn by workers in certain environments. Many molten metal workers find themselves in areas where they are required to wear PPE Category 2-rated clothing.

There is a need for flame resistant fabrics that effectively protect against molten metal splash. Fabrics currently used in this application are homogenous, using the same fiber blend in all the yarns such that the fabric front and back faces are identical. This approach has been considered necessary to provide protection from molten metal adherence. One example commonly used in molten aluminum splash protection is wool blended with FR rayon. Nylon may optionally be incorporated in the fiber blend for durability and abrasion resistance. The wool fibers protect against molten aluminum splash by allowing aluminum to shed off the fabric. However, wool feels relatively harsh on the skin (i.e., is uncomfortable) and is an expensive fiber. Thus, there is a need for more comfortable lightweight fabrics that afford the requisite protection against molten metal splash.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the present invention relate to flame resistant fabrics that provide protection against molten metal splash but that have improved comfort at a lower cost by predominantly locating the protective molten metal shedding fibers on the front face of the fabric. Concentrating the protective fibers predominantly on the front face of the fabric still provides good protection against molten metal adherence and allows for more comfortable (and less expensive) fibers to be used on the back face of the fabric positioned next to the wearer. In this way, overall protection of the fabric is maintained while improving comfort. Embodiments of such fabrics may also achieve NFPA 70E PPE Category 2 protection (≥8 cal/cm$^2$ arc rating whether ATPV or EBT).

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The fabrics described herein have anisotropic properties in that the fabrics are constructed such that the body side of the fabric (the side of the fabric proximate the wearer (assuming the fabric will be incorporated into a garment)) and the face side of the fabric (the side of the fabric facing away from the wearer) have different properties. More specifically, in some embodiments a higher percentage of molten metal shedding fibers (or yarns containing the fibers) are located and exposed on the face side of the fabric (as opposed to on the body side of the fabric). In such embodiments, a higher percentage of less expensive and more comfortable fibers (or yarns containing the fibers) are located and exposed on the body side of the fabric (as opposed to on the face side of the fabric). In such embodiments, the face side of the fabric thus effectively sheds molten metal and the body side of the fabric provides superior comfort and/or lower cost in relation to the face side of the fabric.

Fabrics according to embodiments of the present invention can be formed pursuant to any method that results in the fabric having different properties on the body side and the face side of the fabric. In some embodiments, the fabrics are a woven, knitted, and/or nonwoven fabric.

Woven and/or knitted fabrics may be formed to have anisotropic properties through the use of at least a first group of yarns and a second group of yarns, whereby each yarn group has a different fiber blend. The different fiber blend can be attributable to the two yarn groups having different amounts of the same fibers or to the two yarn groups having different fibers or different blends of fibers. In addition, it will be recognized that in some embodiments the yarns need not be blended at all. In other words, some yarns could be 100% of a single fiber type. Regardless, the first group of yarns is predominantly exposed on the face side of the fabric and the second group of yarns is predominantly exposed on the body side of the fabric. In some embodiments, the fabric is formed only of the first group of yarns and the second group of yarns (i.e., these two yarn types form the entirety of the fabric).

Fabrics of the invention may be formed with spun yarns, filament yarns, stretch broken yarns, or combinations thereof. The yarns can comprise a single yarn or two or more individual yarns that are combined together in some form, including, but not limited to, twisting, plying, tacking, wrapping, covering, core-spinning (i.e., a filament or spun core at least partially surrounded by spun fibers or yarns), etc. Embodiments of fabrics disclosed herein are not coated, laminated, or metallized such that the fibers of the yarns remain exposed on the fabric surfaces.

In some embodiments, the yarns of the first group of yarns are spun yarns having a fiber blend that includes fibers proven to shed molten metals, such as molten aluminum and/or molten zinc. Note that suitable types of metal shedding fibers may depend on the type of metal to be shed. Thus, the types of fibers used in embodiments of the invention are not limited to only the fibers identified herein. Rather, alternative or additional fibers can be incorporated into the first group of yarns to impart specific shedding properties tailored for particular molten metals.

Examples of molten aluminum and/or iron shedding fibers for the face side include, but are not limited to, wool, FR rayon, aliphatic polyamide fibers (such as nylon and/or FR nylon fibers), cellulosic, polyester, polyvinyl chloride (PVC), polyvinyl alcohol (PVA), PVC/PVA copolymers, vinal, and combinations of such fibers. Nylon or flame resistant ("FR") nylon, Nylon XF, and Nylon HT are examples of suitable aliphatic polyamides. Suitable cellulosic fibers, include, but are not limited to, natural and synthetic cellulosic fibers (e.g., cotton, rayon, acetate, triacetate, and lyocell, as well as their flame resistant counterparts FR cotton, FR rayon, FR acetate, FR triacetate, and FR lyocell). Examples of rayon fibers include Viscose™ and Modal™ by Lenzing, available from Lenzing Fibers Corporation. An example of an FR rayon material is Lenzing FR™, also available from Lenzing Fibers Corporation, and VISIL™, available from Sateri. Examples of lyocell fibers include TENCEL™, TENCEL G100™ and TENCEL A100™, all available from Lenzing Fibers Corporation. Examples of vinal fibers include Kuralon™ fibers available from Kuraray. Molten aluminum and/or iron shedding fibers will typically not include aramid fibers.

Examples of molten zinc shedding fibers for the front face include, but are not limited to, PBO (polybenzimidizole) fibers and para-aramid fibers. Examples of para-aramid fibers include KEVLAR™ (available from DuPont), TECHNORA™ (available from Teijin Twaron BV of Arnheim, Netherlands), and TWARON™ (also available from Teijin Twaron BV).

In some embodiments, the yarns of the second group of yarns are spun yarns having a fiber blend that include fibers that are more comfortable and less expensive than the metal shedding fibers in the first group of yarns. Such fibers include, but are not limited to, natural and synthetic cellulosic fibers (e.g., cotton, rayon, acetate, triacetate, and lyocell, as well as their flame resistant counterparts FR cotton, FR rayon, FR acetate, FR triacetate, and FR lyocell), modacrylic fibers, nylon fibers, polyester fibers, etc. Examples of suitable modacrylic fibers are PROTEX™ fibers available from Kaneka Corporation of Osaka, Japan, SEF™ available from Solutia, PyroTex® available from PyroTex Fibers GmbH, or blends thereof.

Additional inherently FR fibers and/or non-inherently FR fibers (FR or non-FR) may be included in the fibers blends of the first and second group of yarns provided the resulting fabric formed by these yarns includes a face side to which a particular molten metal does not adhere and a body side that is more comfortable than the face side. Such additional fibers include, but are not limited to, meta-aramid fibers, polybenzimidazole ("PBI") fibers, poly(2,6-diimidazo [4,5-b:40; 50-e]-pyridinylene-1,4(2,5-dihydroxy)phenylene} ("PIPD") fibers, ultra-high molecular weight (UHMW) polyethylene fibers, UHMW polypropylene fibers, polyvinyl alcohol fibers, polyacrylonitrile (PAN) fibers, liquid crystal polymer fibers (e.g., aromatic polyesters such as VECTRAN), glass fibers, polynosic rayon fibers, carbon fibers, silk fibers, polyamide fibers, polyester fibers, aromatic polyester fibers, TANLON™ fibers (available from Shanghai Tanlon Fiber Company), wool fibers, melamine fibers (such as BASOFIL™, available from Basofil Fibers), polyetherimide fibers, polyethersulfone fibers, pre-oxidized acrylic fibers, polyamide-imide fibers such as KERMEL™, polytetrafluoroethylene fibers, polyvinyl chloride fibers, polyetheretherketone fibers, polyetherimide fibers, polychlal fibers, polyimide fibers, polyamide fibers, polyimideamide fibers, polyolefin fibers, polyacrylate fibers, and any combination or blend thereof. Examples of meta-aramid fibers include NOMEX™ (available from DuPont), CONEX™ (available from Teijin), and APYEIL™ (available from Unitika). An example of a polyester fiber is DACRON® (available from Invista™). An example of a PIPD fiber includes M5 (available from Dupont). An example of melamine fibers is BASOFIL™ (available from Basofil Fibers). An example of PAN fibers is Panox® (available from the SGL Group). Examples of UHMW polyethylene materials include Dyneema and Spectra. An example of a liquid crystal polymer material is VECTRAN™ (available from Kuraray).

It has also been discovered that incorporating into the fabric (via the first group of yarns, second group of yarns, or otherwise) fibers having at least one energy absorbing and/or reflecting additive increases the arc rating of the fabric without sacrificing the molten metal protection and while still complying with all requisite thermal protective requirements. In this way, overall molten metal protection of the fabric is maintained while improving comfort and increasing arc protection.

It is believed that such energy (e.g., radiation) absorbing and/or reflecting additives serve to prevent heat energy transmission through the fabric and to the wearer's skin by absorbing the energy and/or reflecting the energy away from the fabric such that it does not reach the wearer. Examples of such additives include, but are not limited to, dye or pigment additives, such as (but not limited to):

- carbon black;
- anthraquinone black;
- aniline black;
- phthalocya nines;
- perylene diimides;
- terrylene diimides;
- quaterrylene diimides;
- vat dyes (e.g., vat black 8, vat black 16, vat black 20, vat black 25, vat blue 8, vat blue 19, vat blue 43, vat green 1);
- graphite;
- graphene;
- metal oxides (white titanium dioxide, $TiO_2$, silica, and yellow, brown, and black iron oxides); and
- a vat dye selected from the group consisting of dibenzanthrone derivatives, isobenzanthrone derivatives, and pyrazolanthrone derivatives.

Additive-containing fibers ("AC fibers") are fibers whereby an energy absorbing and/or reflecting additive, including but not limited to those identified above, is introduced during the process of manufacturing the fibers themselves and not after fiber formation. This is in contrast to a finish applied onto the fabric surface whereby a binder typically must be used to fix the additive onto the fabric. In these cases, the additive is apt to wash and/or wear/abrade off the fabric during laundering. Provision of the additive in the fibers during fiber formation results in better durability as the additive is trapped within the fiber structure.

Note that while AC fibers may be used in embodiments of the fabrics contemplated herein, they need not always be used. Moreover, the AC fibers may be incorporated into either or both of the first and second groups of yarns. In some embodiments, the AC fibers are incorporated into the first group of yarns so as to be exposed on the face side of the fabric. In some embodiments, the AC fibers are only incorporated into the first group of yarns and not incorporated into the second group of yarns.

In some embodiments, the AC fibers are aramid fibers (such as meta-aramid, para-aramid, or blends thereof), FR rayon, FR cellulosics, FR modacrylic, Kermel, FR polyacrylate (PyroTex), FR nylon, PBI, PBO, and FR polyester, modacrylic fibers, ultra-high molecular weight (UHMW) polyethylene fibers, UHMW polypropylene fibers, polyvinyl alcohol fibers, liquid crystal polymer fibers, nylon (and FR nylon) fibers, silk fibers, polyamide fibers, polyester fibers, natural and synthetic cellulosic fibers (e.g., cotton, rayon, acetate, triacetate, and lyocell), wool fibers, pre-oxidized acrylic fibers, polyamide fibers, polyolefin fibers, and polyacrylate fibers.

In some embodiments, at least some (or all) of the AC fibers used in embodiments of the fabric (including any of the fibers referenced in the previous paragraph) are producer-colored fibers. In producer coloring (also known as "solution dyeing"), pigment is injected into the polymer solution prior to forming the fibers. Thus, "producer-colored" fibers refers to fibers that are colored during the process of manufacturing the fibers themselves and not after fiber formation. It has been found that darker-colored additives (such as navy and black) are particularly effective at increasing the arc rating/fabric weight. However, embodiments of this invention are by no means limited to such darker-colored additives.

The AC fibers provided in the fabric need not all be the same. For example, the fiber blend may include the same type of AC fiber or, alternatively, different types of AC fibers may be provided in the blend.

In some embodiments, the AC fibers (such as the AC version of any of the fibers identified above) constitute 5-60%, inclusive, of the fiber blend of the fabric; 10-50%, inclusive, of the fiber blend of the fabric; 15-40%, inclusive, of the fiber blend of the fabric; 15-35%, inclusive, of the fiber blend of the fabric; 15-30%, inclusive, of the fiber blend of the fabric; 20-30%, inclusive, of the fiber blend of the fabric; or 20-25%, inclusive, of the fiber blend of the fabric. In some embodiments, the AC fibers constitute at least 5% or at least 10% or at least 15% or at least 20% and (i) no more than 60%, (ii) no more than 50%, (iii) no more than 40%, (iv) no more than 35%, (v) no more than 30%, or (vi) no more than 25% of the fiber blend of the fabric.

The first group of yarns preferably includes molten metal shedding fibers (which may depend on the particular type of metal being shed). In fabrics designed to protect against molten aluminum splash, the first group of yarns preferably includes wool fibers such that the wool fibers will be exposed on the face side of the fabric to shed the molten metal. In some embodiments, the first group of yarns includes at least 20% wool fibers, at least 30% wool fibers, at least 40% wool fibers, at least 50% wool fibers, at least 60% wool fibers, or at least 70% wool fibers. Given that aluminum tends to stick to modacrylic fibers, the first group of yarns is preferably devoid of modacrylic fibers or the percentage of modacrylic in the first group of fibers is limited (e.g., to less than 25%, less than 20%, less than 15%, less than 10% or less than 5%). In some embodiments, the first group of yarns includes a blend of wool and cellulosic fibers. In some embodiments, the first group of yarns includes approximately (i) 30-80% wool fibers and 20-70% cellulosic fibers (FR and/or non-FR), inclusive and/or (ii) 40-70% wool fibers and 30-60% cellulosic fibers (FR and/or non-FR), inclusive. In some embodiments, the first group of yarns includes approximately 40-70% wool fibers and 30-50% cellulosic fibers (FR and/or non-FR), inclusive. In some embodiments, different cellulosic fibers are used in the fiber blend of the first group of yarns. In some embodiments, nylon fibers are added to the fiber blend of the first group of yarns to increase durability and abrasion resistance. In some embodiments, the first group of yarns includes approximately (i) 30-60% wool fibers, 20-60% cellulosic fibers (FR and/or non-FR) and 5-20% nylon fibers, inclusive; (ii) 40-60% wool fibers, 25-45% cellulosic fibers (FR and/or non-FR) and 10-20% nylon fibers, inclusive; (iii) 35-55% wool fibers, 25-55% cellulosic fibers (FR and/or non-FR) and 5-20% nylon fibers, inclusive; (iv) 40-50% wool fibers, 30-50% cellulosic fibers (FR and/or non-FR) and 10-20% nylon fibers, inclusive; (v) 40-50% wool fibers, 30-45% cellulosic fibers (FR and/or non-FR) and 10-20% nylon fibers, inclusive; and/or vi) 45-55% wool fibers, 30-40% cellulosic fibers (FR and/or non-FR) and 10-20% nylon fibers, inclusive. In some embodiments, the first group of yarns include lyocell fibers (FR or non-FR) and/or rayon fibers (FR or non-FR). In some embodiments, the first group of yarns include FR rayon fibers. The first group of yarns may also include AC fibers to help impart arc protection. In some embodiments, the AC fibers are AC rayon fibers and, more specifically but not necessarily, AC FR rayon fibers. In some embodiments, the AC fibers are producer-colored fibers such as producer-colored rayon fibers, and, more specifically but not necessarily, producer-colored FR rayon fibers. In some embodiments, the first group of yarns are devoid of aramid fibers.

The second group of yarns preferably includes cellulosic fibers. In some embodiments, the second group of yarns includes a blend of cellulosic fibers and modacrylic fibers, which enhance thermal and arc protection. In some embodiments, different cellulosic fibers are used in the fiber blend of the second group of yarns (e.g., blends of lyocell and rayon, blends of FR and non-FR cellulosic fibers, etc.). In some embodiments, the second group of yarns includes approximately (i) 10-60% modacrylic fibers and 40-90% cellulosic fibers (FR and/or non-FR), inclusive and/or (ii) 15-40% modacrylic fibers and 60-85% cellulosic fibers (FR and/or non-FR), inclusive. In some embodiments, the second group of yarns includes approximately 10-40% modacrylic fibers and 50-80% cellulosic fibers (FR and/or non-FR), inclusive. In some embodiments, nylon fibers are added to the fiber blend of the second group of yarns to increase durability and abrasion resistance. In some embodiments, the second group of yarns includes approximately: (i) 10-50% modacrylic fibers, 40-90% cellulosic (FR and/or non-FR) and 5-20% nylon, inclusive; (ii) 10-40% modacrylic fibers, 40-80% cellulosic (FR and/or non-FR) and 5-15% nylon, inclusive; (iii) 15-30% modacrylic fibers, 50-70% cellulosic (FR and/or non-FR) and 5-15% nylon, inclusive; (iv) 15-30% modacrylic fibers, 60-80% cellulosic (FR and/or non-FR) and 10-20% nylon, inclusive; and/or (v) 15-25% modacrylic fibers, 50-70% cellulosic (FR and/or non-FR) and 5-15% nylon, inclusive. In some embodiments, the modacrylic fibers are additive containing modacrylic fibers, such as described U.S. Patent Application No. 2017/0295875 to Ohzeki et al. (incorporated herein by this reference). In some embodiments, modacrylic fibers constitute 50% or less, 40% or less, 30% or less, or 20% or less of the fiber blend of the second group of yarns. In some embodiments, the second group of yarns are devoid of aramid fibers and/or are devoid of wool fibers. In some embodiments, the fabric is devoid of aramid fibers.

In some embodiments, the fabrics are woven fabrics formed of the first group of yarns and the second group of yarns. In some embodiments, only the first group of yarns will be oriented in the warp direction and only the second group of yarns will be oriented in the fill direction. In this way, the fibers on the face side of the fabric will predominantly comprise those of the first group of yarns and the fibers on the body side of the fabric will predominantly comprise those of the second group of yarns.

In other embodiments, not all of the warp or fill yarns are the same. For example, the first and second groups of yarns may be provided in both the warp and fill directions by providing the first group of yarns on some ends and picks and the second group of yarns on other ends and picks (in any sort of random arrangement or alternating pattern). Or all of the yarns in one of the warp or fill direction could be identical (e.g., either all first group of yarns or all second group of yarns) and different yarns (both first and second groups of yarns) used only in the other of the warp or fill direction.

The fabric may be constructed with the first and second groups of yarns in a variety of ways, including but not limited to, one or more of twill weave (2×1, 3×1, etc.), satin weave (4×1, 5×1, etc.), sateen weave, and double-cloth constructions, or any other weave where yarn is predominantly more on one side of the fabric than the other side of the fabric. A person skilled in the art would be familiar with and could utilize suitable fabric constructions.

It will also be recognized that any woven fabric will have both warp and fill yarns visible on each side of the fabric. Fabrics woven in accordance with some embodiments of the present invention, however, are woven such that more of the first group of yarns are located on the face side of the fabric, and thus more of the second group of yarns are located on the body side of the fabric. Thus, in an exemplary fabric construction in which more of the first group of yarns are located or exposed on the face side of the fabric and more of the second group of yarns are located or exposed on the body side of the fabric, the first group of yarns are "predominantly" exposed on the face side of the fabric (even though some of the first group of yarns would be visible from the body side of the fabric) and the second group of yarns are "predominantly" exposed on the body side of the fabric (even though some of the second group of yarns would be visible from the face side of the fabric).

In other embodiments of the invention, a knit fabric that has different properties on each side of the fabric can be constructed. Such a fabric could be constructed using yarns knitted with single knit technology (for example, plating, etc.) or double-knit technology such that the first group of yarns will be predominantly exposed on the face side of the fabric and the second group of yarns will be predominantly exposed on the opposing body side of the fabric.

Embodiments of the fabric can be of any weight, but in some embodiments are between 6-16 ounces per square yard (osy), inclusive. In some embodiments, the fabrics disclosed herein have a weight between 6-14 osy, inclusive; 7-13 osy, inclusive; 7.5-12.5 osy, inclusive; 8-12 osy, inclusive; 8.5-12.5 osy, inclusive; 8.5-12 osy, inclusive; 8.5-11 osy, inclusive; 9-11 osy, inclusive; and 9-10 osy, inclusive. In some embodiments, the fabric weight is at least 7.5 osy but less than or equal to 12 osy, 11 osy, 10 osy, 9 osy, and/or 8 osy. In some embodiments, the fabric weight is at least 8.5 osy but less than or equal to 11 osy and/or 10 osy.

The fabrics described herein can be incorporated into any type of single or multi-layer garment (uniforms, shirts, jackets, trousers and coveralls) where protection against molten metal splash, electric arc flash and/or flames is needed and/or desirable.

Embodiments of fabrics disclosed herein satisfy the requirements of ASTM F1002 and/or ISO 11612. More specifically, some embodiments of the fabrics disclosed herein satisfy the breaking strength, tearing strength, char length, and after flame requirements for "not coated, laminated, or metallized" primary protective fabrics and/or pants and/or shirt secondary protective fabrics, as set forth in Table 1 of ASTM F1002. Embodiments of fabrics disclosed herein also satisfy the radiant heat requirements (RHR) for secondary protective fabrics, as set forth in Table 1 of ASTM F1002. Additionally, these fabrics should have minimal evidence of molten metal adhesion when tested according to ASTM F955 and/or ISO 9185. More specifically, fabrics should achieve a metal splash performance level rating (as set forth in ISO 11612) of D1 or E1 when tested according to ISO 9185, but preferably achieve a metal splash rating of D2 or E2 and even more preferably achieve a metal splash rating of D3 or E3. Embodiments of the fabrics contemplated herein also preferably achieve a numerical rating of 3 or less when tested for molten substance sticking, material shrinkage, and/or material breakopen pursuant to ASTM F955. Some embodiments of the fabrics contemplated herein also have an arc rating (ATPV or $E_{BT}$) greater or equal to 8 cal/cm$^2$ (when tested according to ASTM F1959) so as to have a PPE Category 2 rating under NFPA 70E.

The following fabrics were made and tested (where "F" denotes "fabric"):

TABLE 2

| Fabric | Warp Yarns (exposed on face side of fabric) | Fill Yarns (exposed on body side of fabric) | AC fibers? | Weight (osy) | Width - IP (in.) | Construction | Weave |
|---|---|---|---|---|---|---|---|
| F1 | 50% FR rayon/40% wool/10% nylon | 50% modacrylic/50% non-FR lyocell | No | 7.8 | 61.2 | 78 × 52 | 2 × 1 Twill |
| F2 | 25% modacrylic/25% non-FR lyocell/40% wool/10% nylon | 50% modacrylic/50% non-FR lyocell | No | 7.8 | 61.1 | 76 × 52 | 2 × 1 Twill |
| F3 | 25% modacrylic/25% non-FR lyocell/40% wool/10% nylon | 40% modacrylic/40% non-FR lyocell/20% wool | No | 7.6 | 62.6 | 79 × 47 | 2 × 1 Twill |
| F4 | 50% wool/40% FR rayon/10% nylon | 50% non-FR lyocell/40% modacrylic/10% nylon | No | 7.7 | 61.2 | 84 × 44 | 2 × 1 Twill |
| F5 | 50% wool/40% FR rayon/10% nylon | 40% modacrylic/40% non-FR lyocell/10% FR rayon/10% nylon | No | 7.8 | 60.9 | 83 × 44 | 2 × 1 Twill |
| F6 | 50% wool/20% non-FR lyocell/20% modacrylic/10% nylon | 35% modacrylic/35% non-FR lyocell/30% FR rayon | No | 7.9 | 61.3 | 83 × 45 | 2 × 1 Twill |
| F7 | 50% wool/35% black FR rayon/15% nylon | 50% FR rayon/20% modacrylic/20% non-FR lyocell/10% nylon | Yes - black FR rayon in warp | 7.6 | 61.5 | 80 × 46 | 2 × 1 Twill |
| F8 | 50% wool/35% black FR rayon/15% nylon | 50% FR rayon/20% modacrylic/20% non-FR lyocell/10% nylon | Yes - black FR rayon in warp | 8.9 | 60.8 | 74 × 50 | 2 × 1 Twill |

It is noted that not all of these fabrics (F1-F8) follow every recommended fabric design principle contemplated herein.

Fabrics F1 to F8 were tested and compared against the following prior art fabrics representative of fabrics currently used for molten metal splash protection (where "PA" indicates a prior art fabric):

TABLE 3

| Fabric | Warp Yarns | Fill Yarns | AC fibers? | Weight (osy) | Width - IP (in.) | Construction | Weave |
|---|---|---|---|---|---|---|---|
| PA-1 | 50% FR rayon/40% wool/10% nylon | 50% FR rayon/40% wool/10% nylon | No | 7.9 | 59.8 | 71 × 59 | 2 × 1 Twill |
| PA-2 | 50% FR rayon/40% wool/10% nylon | 50% FR rayon/40% wool/10% nylon | No | 10.1 | 61.6 | 66 × 46 | 2 × 1 Twill |

Tables 4A and 4B set forth the testing results of various properties of fabrics F1-F8 and prior art fabrics PA-1 and PA-2.

Tables 4A and 4B reflect compliance of Inventive Fabrics F1 to F8 with the vertical flammability (char length and after flame), breaking strength, and tearing strength requirements

TABLE 4A

| Property | PA-1 | PA-2 | F1 | F2 | F3 | ASTM F1002 Requirement |
|---|---|---|---|---|---|---|
| Vertical Flammability - before wash: | | | | | | |
| After Flame (sec) | 0 × 0 | 0 × 0 | 0 × 0 | 0 × 0 | 0 × 0 | <2 × 2 sec. |
| Char length (in) | 4.3 × 4.3 | 1.6 × 1.8 | 6.0 × 5.2 | 4.8 × 4.1 | 4.4 × 3.7 | <6 × 6 in. |
| After Glow (sec) | 1 × 1 | 1 × 1 | 1 × 1 | 2 × 1 | 2 × 1 | — |
| Vertical Flammability - after 25 launderings*: | | | | | | |
| After Flame (sec) | 0.3 × 1.3 | 0 × 0.2 | 0 × 0 | 0 × 0 | 0 × 0 | <2 × 2 sec. |
| Char length (in) | 3.3 × 3.6 | 1.5 × 1.5 | 4.9 × 4.5 | 4.5 × 4.2 | 5.0 × 4.3 | <6 × 6 in. |
| After Glow (sec) | 0.7 × 0.2 | 1 × 1 | 1 × 1 | 16 × 6 | 13 × 2 | — |
| Breaking Strength (pounds force) | 112 × 85 | 143 × 104 | 111 × 92 | 128 × 92 | 138 × 72 | 50 × 50 |
| Tearing Strength (pounds force) | 7.3 × 6.5 | 8.0 × 7.2 | 6.3 × 8.2 | 8.0 × 9.1 | 8.7 × 9.3 | 5 × 5 |
| Dimensional Change - after 5 launderings* (%) | −8.7 × −5.1 | −8.3 × −4.7 | −9.7 × −1.8 | −7.6 × −1.9 | −7.8 × −1.4 | Report Value |
| Metal Splash Performance Rating (ISO 11612) | D2/E3 | D3/E3 | — | — | — | Report Value |
| Arc Rating (cal/cm$^2$) | 6.9 | 7.4 | — | 9.6 | 7.6 | N/A |

*The fabrics were laundered in accordance with AATCC Method 135, 3, IV, A iii (*Dimensional Changes of Fabrics after Home Laundering*, 2018 edition, incorporated herein by reference). More specifically, the fabrics were laundered via permanent press at 120° F.

TABLE 4B

| Property | F4 | F5 | F6 | F7 | F8 | ASTM F1002 Requirement |
|---|---|---|---|---|---|---|
| Vertical Flammability - before wash: | | | | | | |
| After Flame (sec) | 0 × 0 | 0 × 0 | 0 × 0 | 0 × 0 | 0 × 0 | <2 × 2 sec. |
| Char length (in) | 4.9 × 4.6 | 5.3 × 4.7 | 4.6 × 4.8 | 3.1 × 3.1 | 2.1 × 2.8 | <6 × 6 in. |
| After Glow (sec) | 1 × 1 | 1 × 1 | 1 × 1 | 1 × 1 | 1 × 1 | — |
| Vertical Flammability - after 25 launderings*: | | | | | | |
| After Flame (sec) | 0 × 0 | 0 × 0 | 0 × 0 | 0.3 × 0.2 | 0 × 0 | <2 × 2 sec. |
| Char length (in) | 4.2 × 4.2 | 4.5 × 4.0 | 4.2 × 4.2 | 3.2 × 3.1 | 3.5 × 3.7 | <6 × 6 in. |
| After Glow (sec) | 1 × 1 | 1 × 1 | 1 × 1 | 1 × 1 | 1 × 1 | — |
| Breaking Strength (pounds force) | 118 × 87 | 124 × 96 | 141 × 96 | 126 × 83 | 155 × 98 | 50 × 50 |
| Tearing Strength (pounds force) | 8 × 12.6 | 7.6 × 13.1 | 8.3 × 11 | 9.2 × 12 | 10 × 11.9 | 5 × 5 |
| Dimensional Change - after 5 launderings* (%) | −9.1 × −1.1 | −9.1 × −1.0 | −8.1 × −2 | −11.4 × −3.1 | −5.1 × −4.5 | Report Value |
| Metal Splash Performance Rating (ISO 11612) | — | — | — | — | D2/E3 | Report Value |
| Arc Rating (cal/cm$^2$) | 7.4 | 8.5 | 8.5 | 7.7 | 9.7 | N/A |

*The fabrics were laundered in accordance with AATCC Method 135, 3, IV, A iii (*Dimensional Changes of Fabrics after Home Laundering*, 2018 edition, incorporated herein by reference). More specifically, the fabrics were laundered via permanent press at 120° F.

of ASTM F1002. Moreover, many of the fabrics were able to attain an arc rating greater or equal to 8 cal/cm$^2$.

Table 5 sets forth the visual ratings of the fabrics upon exposure to molten aluminum pursuant to ASTM F955.

TABLE 5

| Fabric | Sticking | Charring | Shrinkage | Breakopen |
|---|---|---|---|---|
| PA-1 | 1.5 | 4 | 1 | 1 |
| PA-2 | 1.5 | 3 | 1 | 1 |
| F1 | 3 | 4.5 | 1.5 | 4 |
| F2 | 3 | 4.5 | 1.5 | 3 |
| F3 | 2.5 | 4 | 1 | 3 |
| F4 | 2.5 | 4 | 1 | 1 |
| F5 | 2.5 | 4 | 1 | 2 |
| F6 | 3 | 4 | 1 | 3 |
| F7 | 1.5 | 4 | 1 | 2 |
| F8 | 1 | 3 | 1 | 1 |

All of Fabrics F1 to F8 achieved a rating of 3 or better (i.e., less than 3) when tested for molten substance sticking, material shrinkage, and material breakopen pursuant to ASTM F955.

Fabrics according to embodiments of the present invention strategically place fibers necessary from molten metal protection (which tend to be more expensive and less comfortable) on the face side of the fabric and more comfortable, less expensive fibers on the body side of the fabric. These fabrics thus provide the requisite protection to the wearer while rendering the garment more comfortable and affordable as compared to existing fabrics designed to protect against molten metal splash.

Different arrangements of the components described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A fabric formed by a first group of yarns and a second group of yarns, wherein the fabric has a face side, a body side, a first direction, and a second direction opposite the first direction and wherein:

i. the first group of yarns comprises a first fiber blend, wherein the first fiber blend comprises molten metal shedding fibers;

ii. the second group of yarns comprises a second fiber blend that is different from the first fiber blend and that comprises cellulosic fibers;

iii. the first group of yarns is predominantly exposed on the face side of the fabric;

iv. the second group of yarns is predominantly exposed on the body side of the fabric;

v. the fabric has a breaking strength of at least 50 pounds force in both the first direction and the second direction when tested in accordance with ASTM D5034 (2009);

vi. the fabric has a tearing strength of at least 5 pounds force in both the first direction and the second direction when tested in accordance with ASTM D1424 (2009);

vii. the fabric has a char length of at least 6 inches and an afterflame of 2 seconds or less when tested pursuant to ASTM D6413 (2015);

viii. the fabric has a fabric weight between 6 to 14 ounces per square yard, inclusive; and ix. the fabric has an arc rating of at least 8 cal/cm$^2$ when tested pursuant to ASTM F1959 (2014).

2. The fabric of claim 1, wherein the fabric is a woven fabric having a warp direction and a fill direction, wherein the first direction is the warp direction, the second direction is the fill direction, the first group of yarns is provided only in one of the warp direction or the fill direction, and the second group of yarns is provided only in the other of the warp direction or the fill direction.

3. The fabric of claim 1, wherein the molten metal shedding fibers comprise wool and cellulosic fibers and wherein the first fiber blend comprises approximately 40-70% wool fibers, inclusive, and approximately 30-50% cellulosic fibers, inclusive.

4. The fabric of claim 3, wherein the first fiber blend comprises approximately 40-60% wool fibers, inclusive, and approximately 25-45% cellulosic fibers, inclusive, and wherein the first fiber blend further comprises approximately 10-20% nylon fibers, inclusive.

5. The fabric of claim 3, wherein at least some of the cellulosic fibers in the first fiber blend comprise flame resistant cellulosic fibers.

6. The fabric of claim 5, wherein at least some of the flame resistant cellulosic fibers comprise additive containing flame resistant cellulosic fibers.

7. The fabric of claim 6, wherein at least some of the additive containing flame resistant cellulosic fibers are producer-colored flame resistant cellulosic fibers.

8. The fabric of claim 7, wherein the producer-colored flame resistant cellulosic fibers comprise rayon fibers.

9. The fabric of claim 1, wherein the first fiber blend is devoid of aramid fibers.

10. The fabric of claim 1, wherein the first fiber blend is devoid of modacrylic fibers.

11. The fabric of claim 1, wherein the second fiber blend comprises approximately 50-80% cellulosic fibers, inclusive, and further comprises approximately 10-40% modacrylic fibers, inclusive.

12. The fabric of claim 11, wherein the second fiber blend comprises approximately 15-30% modacrylic fibers, inclusive, and approximately 60-80% cellulosic fibers, inclusive, and wherein the second fiber blend further comprises approximately 10-20% nylon fibers, inclusive.

13. The fabric of claim 1, wherein the second fiber blend is devoid of aramid fibers.

14. The fabric of claim 1, wherein the second fiber blend is devoid of wool fibers.

15. The fabric of claim 1, wherein the second fiber blend further comprises 40% or less of modacrylic fibers.

16. The fabric of claim 1, wherein the fabric weight is between 8.5 and 12.5 ounces per square yard, inclusive.

17. The fabric of claim 1, wherein the fabric achieves a metal splash performance level rating as set forth in ISO 11612 (2015) of at least D2 or E2 when tested according to ISO 9185 (2007).

18. The fabric of claim 1, wherein the fabric achieves a numerical rating of 3 or less when tested for molten substance sticking, material shrinkage, and material breakopen pursuant to ASTM F955 (2015).

19. A woven fabric formed by a first group of yarns and a second group of yarns, wherein the fabric has a face side, a body side, a warp direction, and a fill direction opposite the first direction and wherein:

i. the first group of yarns comprises a first fiber blend, wherein the first fiber blend comprises wool fibers, cellulosic fibers, and nylon fibers, and wherein the first fiber blend is devoid of modacrylic and aramid fibers;

ii. the second group of yarns comprises a second fiber blend that is different from the first fiber blend and that comprises cellulosic fibers, modacrylic fibers, and nylon fibers, wherein the second fiber blend is devoid of aramid fibers;

iii. at least some of the cellulosic fibers in at least one of the first fiber blend or the second fiber blend comprise producer-colored flame resistant rayon fibers;

iv. the first group of yarns is predominantly exposed on the face side of the fabric;

v. the second group of yarns is predominantly exposed on the body side of the fabric;

vi. the fabric has a breaking strength of at least 50 pounds force in both the first direction and the second direction when tested in accordance with ASTM D5034 (2009);

vii. the fabric has a tearing strength of at least 5 pounds force in both the first direction and the second direction when tested in accordance with ASTM D1424 (2009);

viii. the fabric has a char length of at least 6 inches and an afterflame of 2 seconds or less when tested pursuant to ASTM D6413 (2015);

ix. the fabric has a fabric weight between 8.5 to 12.5 ounces per square yard, inclusive;

x. the fabric has an arc rating of at least 8 cal/cm$^2$ when tested pursuant to ASTM F1959 (2014); and xi. the fabric achieves a metal splash performance level rating as set forth in ISO 11612 (2015) of at least D2 or E2 when tested according to ISO 9185 (2007).

20. The woven fabric of claim 19, wherein the first group of yarns is provided only in one of the warp direction or the fill direction and the second group of yarns is provided only in the other of the warp direction or the fill direction.

* * * * *